US010182643B2

(12) United States Patent
Nicoline

(10) Patent No.: US 10,182,643 B2
(45) Date of Patent: Jan. 22, 2019

(54) BRUSH MAKEUP APPLICATOR HAVING GROOVES

(71) Applicant: Paris Presents Incorporated, Gurnee, IL (US)

(72) Inventor: Alyssa C Nicoline, McHenry, IL (US)

(73) Assignee: Paris Presents Incorporated, Gurnee, IL (US)

( * ) Notice: Subject to any disclaimer, the term of this patent is extended or adjusted under 35 U.S.C. 154(b) by 0 days.

(21) Appl. No.: 15/382,863

(22) Filed: Dec. 19, 2016

(65) Prior Publication Data

US 2018/0168325 A1 Jun. 21, 2018

(51) Int. Cl.
*A46B 9/02* (2006.01)
*A46D 3/00* (2006.01)

(52) U.S. Cl.
CPC ..... *A46B 9/026* (2013.01); *A46B 9/021* (2013.01); *A46B 9/028* (2013.01); *A46D 3/00* (2013.01); *A46B 2200/1046* (2013.01); *A46B 2200/20* (2013.01); *Y10S 15/05* (2013.01)

(58) Field of Classification Search
CPC ..... A46B 9/02; A46B 9/021; A46B 9/023; A46B 9/028; A46B 2200/1033; A46B 2200/1046; A46B 2200/1053; A46B 2200/20; A46B 2200/202; A46B 2200/205; A45D 27/04; A45D 33/36; A45D 34/042; A45D 40/262; Y10S 15/05
USPC ..... 15/159.1, 160, DIG. 5; D4/127, 130, D4/132, 135
See application file for complete search history.

(56) References Cited

U.S. PATENT DOCUMENTS

| | | | | | |
|---|---|---|---|---|---|
| 1,120,476 | A * | 12/1914 | Hansen | A46B 15/00 | 15/104.94 |
| 1,694,364 | A * | 12/1928 | Albright | A46B 15/00 | 15/159.1 |
| 8,060,971 | B1 | 11/2011 | Castelluccio | | |
| D755,525 | S * | 5/2016 | Ward | D4/127 | |
| D755,526 | S * | 5/2016 | Ward | D4/127 | |
| 2007/0151061 | A1* | 7/2007 | Mink | A46B 9/021 | 15/160 |
| 2016/0278502 | A1* | 9/2016 | McGee | A45D 40/262 | |

FOREIGN PATENT DOCUMENTS

| | | | |
|---|---|---|---|
| CN | 205267364 U | | 6/2016 |
| GB | 396846 | * | 8/1933 |

OTHER PUBLICATIONS

Partial machine translation of CN 205267364, Jun. 1, 2016.*
(Continued)

*Primary Examiner* — Mark Spisich
(74) *Attorney, Agent, or Firm* — Quarles & Brady LLP

(57) ABSTRACT

A brush makeup applicator having grooves (100) is provided. The brush makeup applicator having grooves (100) includes a handle (110) having a first end (110*a*) and a second end (110*b*), said first end (110*a*) and second end (110*b*) being disposed along an axis (Y-Y) of the handle (110) and brush (120) affixed to and extending away from the first end (110*a*) to form a substantially planar surface (120*s*) for applying makeup. The brush (120) includes a circular groove (120*a*) formed in the substantially planar surface (120*s*) and an annulus groove (120*b*) formed in the substantially planar surface (120*s*), wherein said annulus groove (120*b*) surrounds the circular groove (120*a*).

17 Claims, 5 Drawing Sheets

(56) References Cited

OTHER PUBLICATIONS

Wehpage, http://www.dhgate.com/store/product/velaperfectingfacebrushmultipurposeliquid/214459604.html; Perfecting Face Brush Multipurpose Liquid Foundation Brush Premium . . . .

International Search Report and Written Opinion issued for International Application No. PCT/US2017/067027, dated Mar. 1, 2018, 9 pages.

* cited by examiner

BRUSH MAKEUP APPLICATOR HAVING GROOVES

TECHNICAL FIELD

The embodiments described below relate to brush makeup applicators and, more particularly, to a brush makeup applicator having grooves.

BACKGROUND OF THE INVENTION

Brush makeup applicators are used to apply makeup to a person's skin, such as the person's face. The makeup may be comprised of, for example, a foundation that is applied to bare skin, shading that is applied to the foundation, or other forms of makeup, such as, for example, colored or tinted makeup that is used in entertainment. The makeup may be a mixture of component makeups, such as mixture or cocktail of a moisturizer and a foundation. The makeup may be in any suitable form, such as powder, liquid, emulsified, etc. The makeup is typically held in a jar or other open top dispenser, in a squeeze bottle with a nozzle, or although any suitable container can be employed.

Before the makeup is applied to the face, the brush makeup applicator is loaded with the makeup. The brush makeup applicator may be loaded with the makeup by, for example, dipping a brush at an end of the brush makeup applicator into the makeup a few times. Alternatively, the makeup may be applied to the brush by using the squeeze bottle. For example, the brush at the end of the brush makeup applicator may be held upright while the user squeezes makeup onto the brush. After the brush makeup applicator is loaded, the makeup may rest on the end of or between bristles in the brush. The user may then press the loaded brush makeup applicator to the skin to apply the makeup.

The brush makeup applicator is typically pressed to the skin in a dabbing and/or wiping stroke. The dabbing strokes can apply the makeup to a particular spot on the skin while the wiping strokes can distribute the makeup to achieve a desired gradient effect, such as shading with tinted makeup. The dabbing strokes are usually performed where it is desirable to have a center or thicker layer of the distributed makeup. For example, blush may be dabbed to the skin at the center of the cheekbones. By wiping the blush in a circular or radial pattern away from the location of the dabbed makeup, a gradient effect may be achieved. An application of the makeup is defined as a series of dabbing and wiping strokes after the brush is loaded.

However, as can be appreciated, the resulting gradient effect can depend significantly on the proper amount of makeup being applied in a given application of the makeup. Sometimes the makeup must be applied multiple times to achieve the desired amount of makeup, which can adversely affect the resulting gradient effect. For example, the blush may be undesirably even over the entire cheekbone due to the multiple dabbing and wiping strokes.

The repetitious application of the makeup can be avoided by loading the brush makeup applicator with a precise and sufficient amount of makeup such that a single application of the makeup can achieve the desired effects. However, it may be difficult to precisely determine the amount of makeup that is retained between the bristles in the brush, or to even retain a sufficient amount of makeup for a given application. In addition, the gradient effect, as well as other desirable effects, can be better controlled by modulating the amount of makeup that is applied during the dabbing or wiping strokes.

SUMMARY OF THE INVENTION

A brush makeup applicator having grooves (100) is provided. According to an embodiment, the brush makeup applicator having grooves (100) comprises a handle (110) having a first end (110*a*) and a second end (110*b*), said first end (110*a*) and second end (110*b*) being disposed along an axis (Y-Y) of the handle (110), and brush (120) affixed to and extending away from the first end (110*a*) to form a substantially planar surface (120*s*) for applying makeup. The brush (120) include a circular groove (120*a*) formed in the substantially planar surface (120*s*), and an annulus groove (120*b*) formed in the substantially planar surface (120*s*), wherein said annulus groove (120*b*) surrounds the circular groove (120*a*).

A method of forming a brush makeup applicator having grooves is provided. According to an embodiment, the method comprises forming a handle having a first end and a second end, said first end and second end being disposed along an axis of the handle, and forming and affixing a brush to the first end such that the brush extends from the first end to form a substantially planar surface for applying makeup. The method also includes forming a circular groove in the substantially planar surface, and forming an annulus groove in the substantially planar surface, wherein said annulus groove surrounds the circular groove.

ASPECTS OF THE INVENTION

According to an aspect, a brush makeup applicator having grooves (100) comprises a handle (110) having a first end (110*a*) and a second end (110*b*), said first end (110*a*) and second end (110*b*) being disposed along an axis (Y-Y) of the handle (110), and brush (120) affixed to and extending away from the first end (110*a*) to form a substantially planar surface (120*s*) for applying makeup. The brush (120) includes a circular groove (120*a*) formed in the substantially planar surface (120*s*), and an annulus groove (120*b*) formed in the substantially planar surface (120*s*), wherein said annulus groove (120*b*) surrounds the circular groove (120*a*).

Preferably, the circular groove (120*a*) has a center (C1) that is collocated with the axis (Y-Y) of the handle (110).

Preferably, the annulus groove (120*a*) has a center (C2) that is collocated with the axis (Y-Y) of the handle (110).

Preferably, the axis (Y-Y) comprises a longitudinal axis of the handle (110).

Preferably, the circular groove (120*a*) and the annulus groove (120*b*) each have a rectangular cross-section.

Preferably, the substantially planar surface (120*s*) is at an angle (θ) relative to the axis (Y-Y) of the handle (110).

Preferably, the handle (110) comprises a first portion (112) having a smooth surface at the first end (110*a*) and a second portion (114) having a textured surface at the second end (110*b*).

Preferably, bristles in the brush (120) extend away from the first end (110*a*) substantially parallel to the axis (Y-Y) of the handle (110).

Preferably, the brush (120) extends away from the first end (110*a*) in a substantially conical shape.

According to an aspect, a method of forming a brush makeup applicator having grooves comprises forming a handle having a first end and a second end, said first end and second end being disposed along an axis of the handle, and forming and affixing a brush to the first end such that the brush extends away from the first end to form a substantially planar surface for applying makeup. The method further comprises forming a circular groove in the substantially planar surface, and forming an annulus groove in the substantially planar surface, wherein said annulus groove surrounds the circular groove.

Preferably, the circular groove has a center that is collocated with the axis of the handle.

Preferably, the annulus groove has a center that is collocated with the axis of the handle.

Preferably, the axis comprises a longitudinal axis of the handle.

Preferably, the circular groove and the annulus groove each have a rectangular cross-section.

Preferably, the substantially planar surface is at an angle relative to the axis of the handle.

Preferably, the handle comprises a first portion having a smooth surface at the first end and a second portion having a textured surface at the second end.

Preferably, bristles in the brush extend away from the first end substantially parallel to the axis of the handle.

Preferably, the brush extends away from the first end in a substantially conical shape.

BRIEF DESCRIPTION OF THE DRAWINGS

The same reference number represents the same element on all drawings. It should be understood that the drawings are not necessarily to scale.

DETAILED DESCRIPTION OF THE INVENTION

FIGS. 1-5B and the following description depict specific examples to teach those skilled in the art how to make and use the best mode of embodiments of a brush makeup applicator having grooves. For the purpose of teaching inventive principles, some conventional aspects have been simplified or omitted. Those skilled in the art will appreciate variations from these examples that fall within the scope of the present description. Those skilled in the art will appreciate that the features described below can be combined in various ways to form multiple variations of the brush makeup applicator having grooves. As a result, the embodiments described below are not limited to the specific examples described below, but only by the claims and their equivalents.

Figure 1:
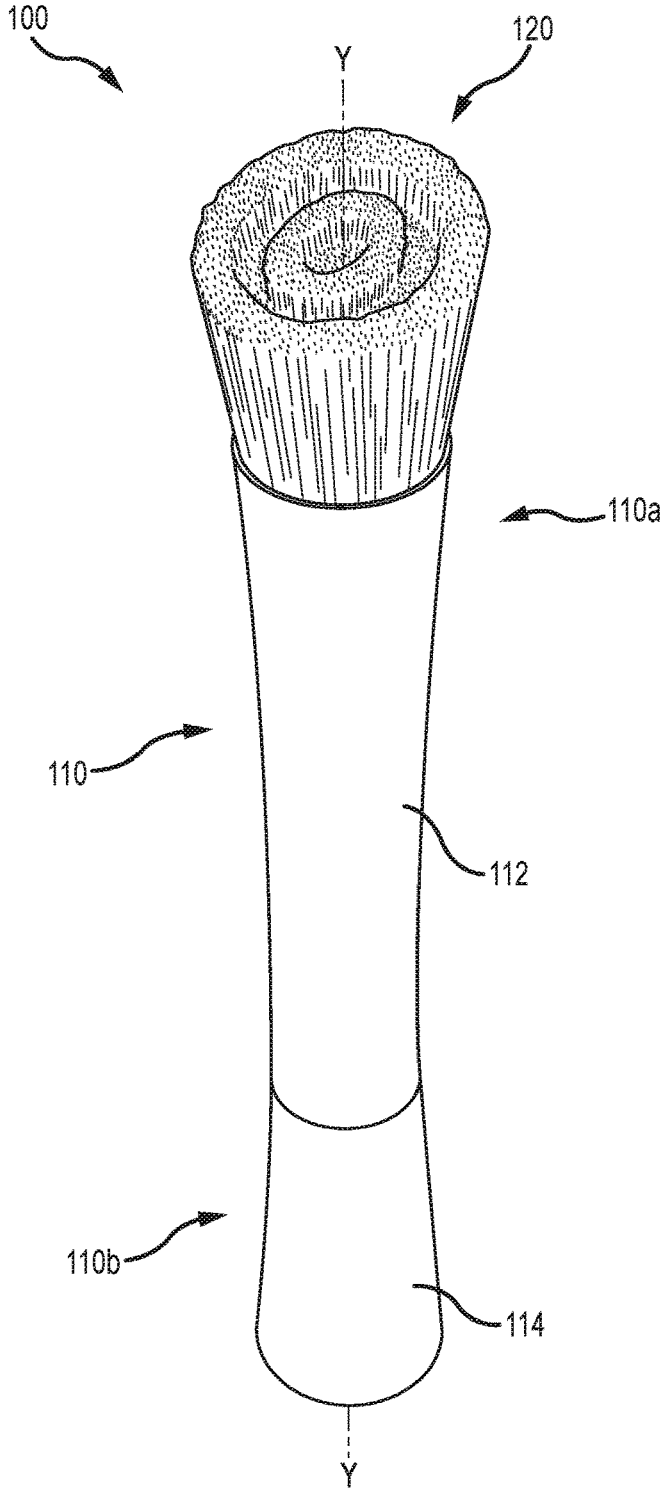
FIG. 1 shows a brush makeup applicator having grooves 100.

FIG. 1 shows a brush makeup applicator having grooves 100. As shown in FIG. 1, the brush makeup applicator having grooves 100 includes a handle 110 and a brush 120. The brush 120 include a circular groove and an annulus groove, which will be described in more detail in the following with reference to FIGS. 2 and 3. The handle 110 has a first end 110*a* and a second end 110*b*. The first end 110*a* and the second end 110*b* are collocated with an axis Y-Y of the handle 110. The brush 120 is affixed to and extends away from the first end 110*a* of the handle 110.

As shown, the axis Y-Y is a longitudinal axis of the handle 110. That is, the axis Y-Y extends along a long dimension of the handle 110. However, in alternative embodiments, the axis Y-Y may comprise a short axis that extends along a short dimension of an alternative handle. For example, a short handle may be substantially disk-shaped such that the short axis extends through a center of the planes of the short handle. Also as shown, the axis Y-Y is straight or linear. However, in alternative embodiments, an axis may be curved, bent, segmented, or the like. Accordingly, an alternative handle may be curved, bent, segmented, etc. between the first end and the second end. An alternative handle may also be asymmetrically disposed about the axis. That is, an outer surface of an alternative handle may be irregular such that the volume of the alternative handle is asymmetrical about the axis.

The handle 110 may be a single integrated piece or may be comprised of a plurality of components. As shown in FIG. 1, the handle 110 comprises a first portion 112 having a smooth surface at the first end 110*a* and a second portion 114 having a textured surface at the second end 110*b*. The first portion 112 may be comprised of a plastic with a metallic plating, although any suitable material capable of having a smooth surface may be employed. The second portion 114 may be comprised of a flexible material, such as a rubber based material, although any suitable material with a textured surface may be employed. The textured surface at the second portion 114 can enhance a user's grip on the handle 110 when loading the brush makeup applicator having grooves 100 or applying the makeup to a person's skin using the brush makeup applicator having grooves 100.

The brush 120 is comprised of a bundle of bristles. The bristles in the brush 120 may be comprised of polymer fibers although any suitable material can be employed. The bristles extend away from the first end 110*a* substantially parallel to the axis Y-Y of the handle 110, with a bend that increases the width of the brush 120 in relation to a distance from the first end 110*a* of the handle 110. Accordingly, the brush 120 extends away from the first end 110*a* in a substantially conical shape. As a result, the brush 120 forms a tapered cylinder that is narrow in proximity to the handle 110.

Figure 2:
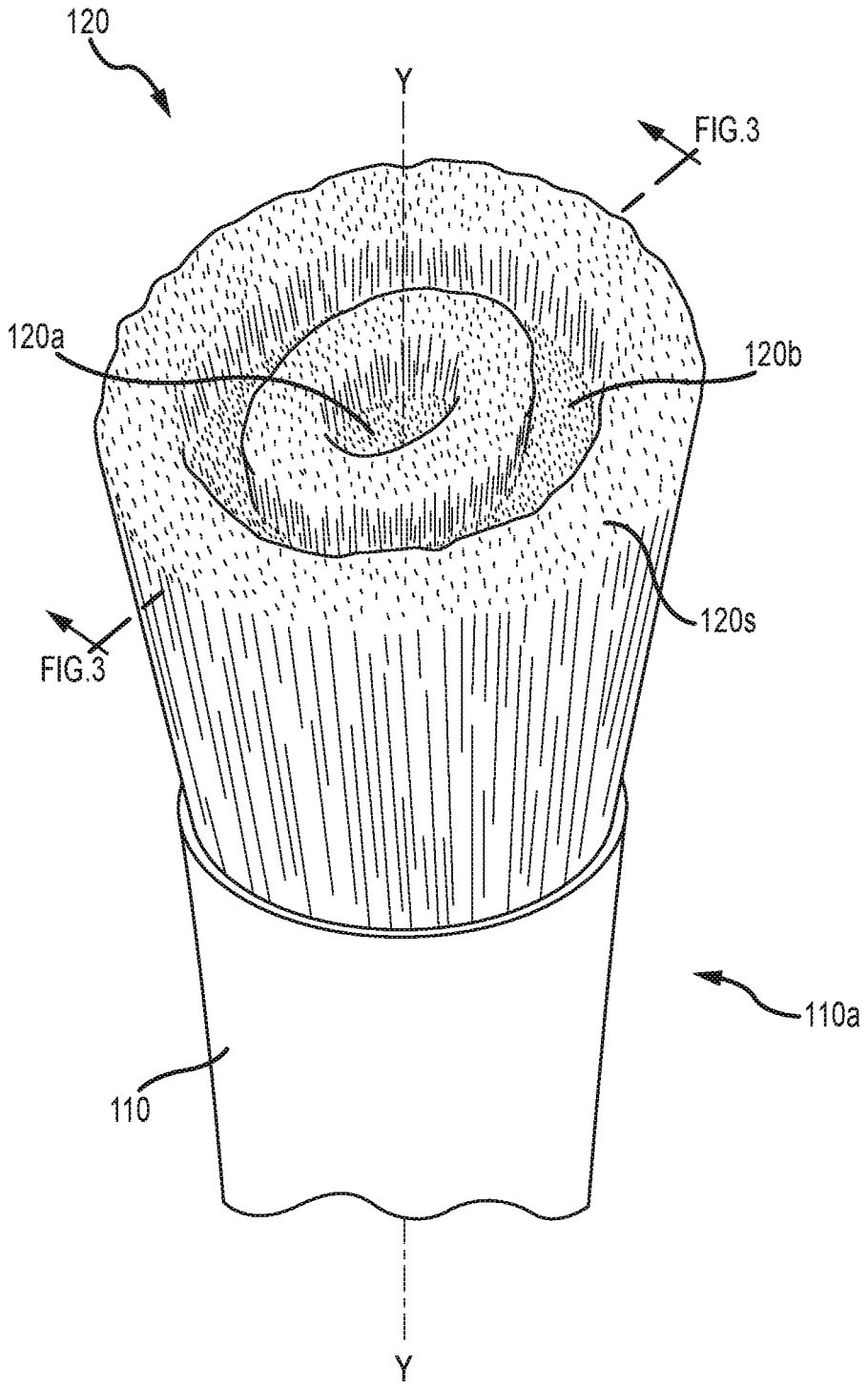
FIGS. 2 and 3 show more detailed views of the brush makeup applicator having grooves 100 and, in particular, the brush 120.
Figure 3:
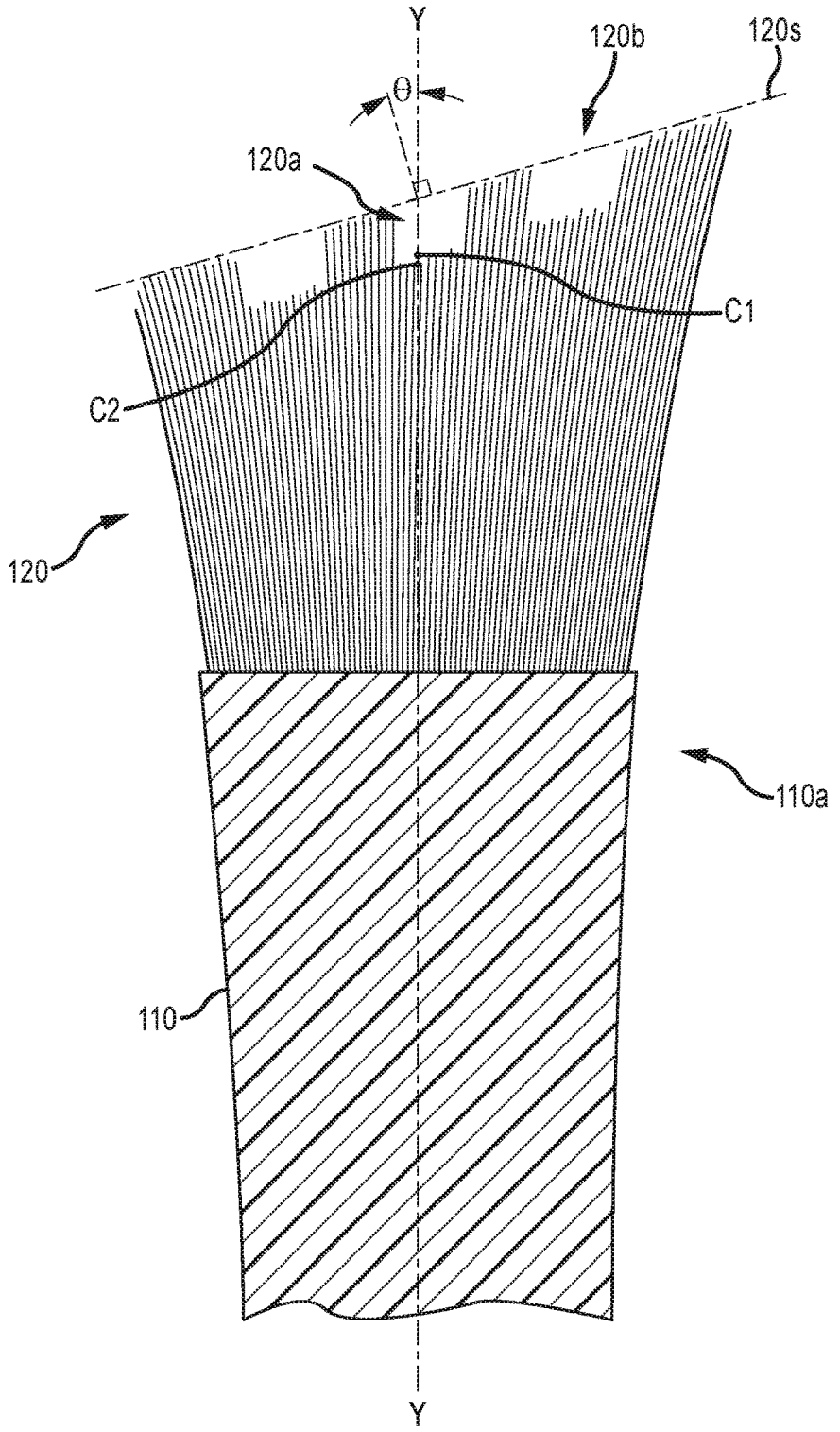

FIGS. 2 and 3 show more detailed views of the brush makeup applicator having grooves 100 and, in particular, the brush 120. The handle 110 is shown with the first end 110*a*. The first end 110*a* is collocated with the axis Y-Y of the handle 110. As shown in FIG. 2, the brush 120 is affixed to and extends away from the first end 110*a* of the handle 110 so as to form a substantially planar surface 120*s*. The substantially planar surface 120*s* is defined by the ends of the bristles of the brush 120 that define the perimeters of the circular groove 120*a* and annulus groove 120*b*. The brush 120 includes a circular groove 120*a* and an annulus groove 120*b*. The annulus groove 120*b* surrounds the circular groove 120*a*. The circular groove 120*a* and the annulus groove 120*b* are formed in the planar surface 120*s*.

As can be appreciated, more than one annulus groove may be employed. For example, the circular groove 120*a* is shown as a disc-shaped groove. In alternative embodiments, the circular groove 120*a* may be an annulus groove. Accordingly, in an alternative embodiment, the annulus groove 120*b* could surround a circular groove 120*a* that is shaped as an annulus groove. Additionally or alternatively, additional annulus grooves may be employed. For example, one or more annulus grooves can surround the circular groove 120*a* and the annulus groove 120*b* shown in FIGS. 2 and 3.

As shown in FIG. 3, the cross-sectional shape of the circular groove 120*a* and the annulus groove 120*b* is rectangular. However, in alternative embodiments, other cross-sectional shapes may be employed, such as an ovoid cross sectional shape, etc. Also as shown in FIG. 3, centers C1, C2 of the circular groove 120*a* and the annulus groove 120*b* are collocated with the axis Y-Y of the handle 110. The centers C1, C2 are collocated with planes (not illustrated) defined by the ends of the bristles that form the bottom of the grooves 120*a*, 120*b*. The centers C1, C2 are shown in FIG. 3 as points that are offset from each other by a small amount. In alternative embodiments, the centers C1, C2 may be collocated or offset from each other by a greater amount. For example, it may be advantageous for a deeper circular groove that can contain more makeup. This can reduce the number of times the brush 120 must be replenished with makeup.

The substantially planar surface 120*s* is shown as a broken line disposed at the end of the brush 120. The substantially planar surface 120*s* is at an angle θ relative to the axis Y-Y of the handle 110. More specifically, a normal vector of the substantially planar surface 120*s* is not parallel or coaxial with the axis Y-Y of the handle 110. The angle θ is approximately 10 degrees although any suitable angle θ, including zero, may be employed in alternative embodiments. A non-zero angle θ may be advantageous in modulating the amount of makeup that is applied with each brush stroke, as will be described in more detail in the following with reference to FIGS. 5A and 5B, after discussing with reference to FIG. 4 how a brush makeup applicator may be formed.

Figure 4:
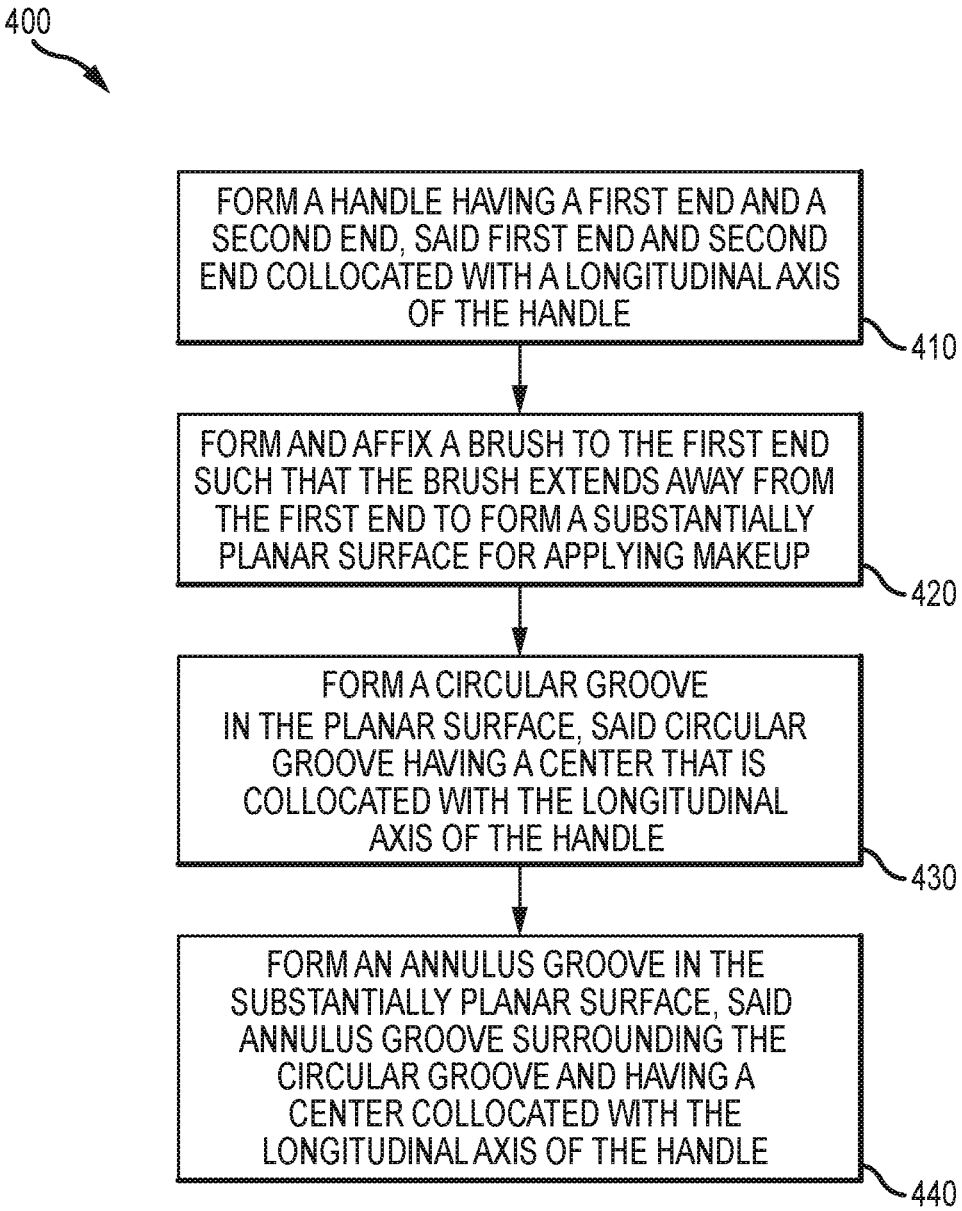
FIG. 4 shows a method 400 of forming the brush makeup applicator.

FIG. 4 shows a method 400 of forming the brush makeup applicator. The brush makeup applicator may be the brush makeup applicator having grooves 100 described in the foregoing with reference to FIGS. 1-3. As shown in FIG. 4, the method 400 begins by forming a handle having a first end and a second end in step 410. The first end and the second end are collocated with an axis of the handle. In step 420, a brush is formed and affixed to the first end of the handle such that the brush extends away from the first end to form a planar surface for applying makeup. A circular groove may be formed in the substantially planar surface in step 430. The circular groove may have a center that is collocated with an axis of the handle. In step 430, an annulus groove may also be formed in the substantially planar surface. The annulus groove surrounds the circular groove. The annulus groove can have a center that is collocated with the axis of the handle.

The handle may be formed in step 410 by any suitable method and from any suitable material or materials, such as injection molding and/or assembling plastic components. Additional steps may be employed, such as finishing, polishing, or the like, the surface of the handle. In an embodiment, a smooth finish may be formed at the first end and a textured surface may be formed at the second end. An opening may be formed in the first end of the handle.

In step 420, the brush can be formed by, for example, bundling bristles comprised of, for example, polymer fibers together and affixing the brush to the first end of the handle formed during step 410. The brush can be affixed to the first end by applying an adhesive to the opening in the first end of the handle and pressing the brush into the opening. The substantially planar surface can be formed by trimming distal ends of the bristles in the brush, although the substantially planar surface may be formed prior to affixing the brush to the first end.

The circular and annulus grooves formed in steps 430 and 440 may be formed by any suitable method, such as, for example, bundling bristles with different lengths so as to form the circular and annulus grooves. Additionally or alternatively, the circular and the annulus grooves may be formed by removing a portion of bristles in the brush after the bundle of bristles is attached to the handle. For example, blades can be used to trim the bristles. More specifically, a tool can grip the handle and/or brush. The blades and/or the handle and bundle of brush can be rotated about the axis of the handle to form the circular and annulus grooves. Additional steps may be employed, such as removing bent bristles, or the like.

Figure 5A:
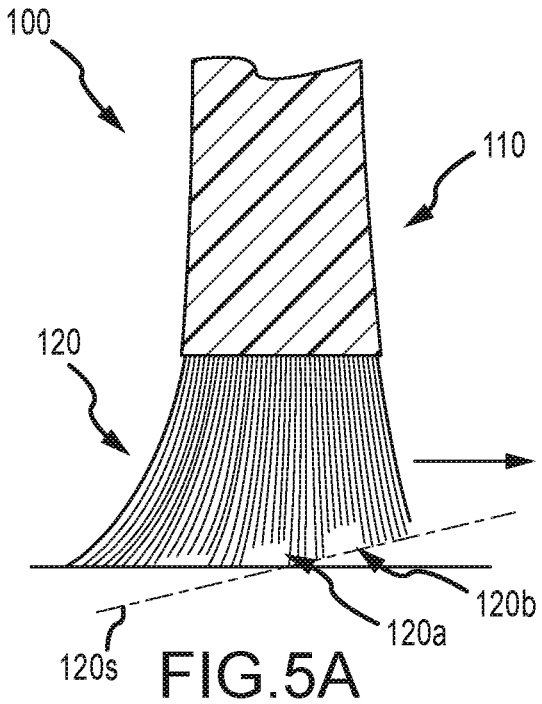
FIGS. 5A and 5B illustrate a method of using the brush makeup applicator having grooves 100 described in the foregoing with reference to FIGS. 1-4.
Figure 5B:
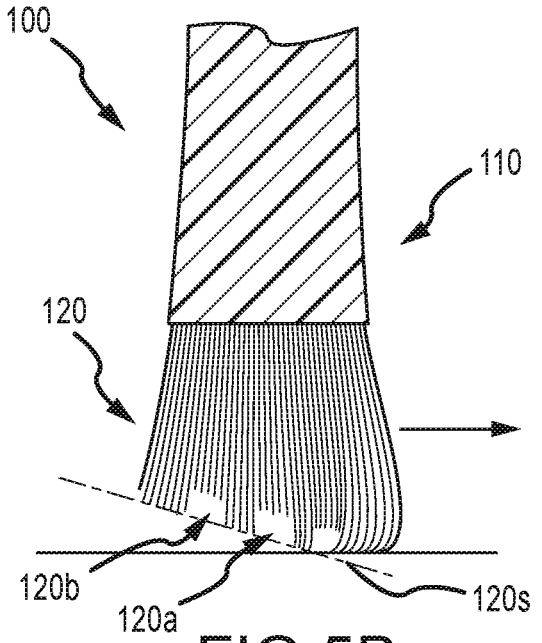

FIGS. 5A and 5B illustrate a method of using the brush makeup applicator having grooves 100 described in the foregoing with reference to FIGS. 1-4. The brush makeup applicator having grooves 100 is shown with the handle 110 and the brush 120. The brush 120 is shown as including the circular groove 120*a* and the annulus groove 120*b*. As shown in FIGS. 5A and 5B, the brush makeup applicator having grooves 100 is applied to a person's skin, which is illustrated as a straight line, although, as can be appreciated, the person's skin may be curved, bumpy, etc.

The brush makeup applicator having grooves 100 is being pressed into the person's skin. Due to being pressed into the person's skin, the brush 120 is bent and displaced. The amount of the bending and displacement of the brush 120 is correlated with a net interference between the brush 120 and the person's skin. The net interference can be quantified as a hypothetical depth of the brush 120 into the person's skin if the brush 120 did not bend or displace. As can be appreciated, the directions of the bending and displacement of the brush 120 depends on a direction of the wiping stroke, which is illustrated by an arrow. The brush makeup applicator having grooves 100 is shown in FIGS. 5A and 5B as applying the makeup in two different directions.

In FIG. 5A, the brush makeup applicator having grooves 100 has a wiping stroke that has a positive angle-of-attack. More specifically, there is a positive angle-of-attack between the planar surface 120*s* and the person's skin. Due to the positive angle-of-attack in FIG. 5A, the brush 120 spread apart, which can increase the width of the circular groove 120*a* and the annulus groove 120*b*. The positive angle-of-attack also presents the circular groove 120*a* and the annulus groove 120*b* to the person's skin. That is, the grooves 120*a*, 120*b* are oriented towards the person's skin and in the direction of the stroke.

In FIG. 5B, there is a negative angle-of-attack between the planar surface 120*s* and the person's skin. Due to the negative angle-of-attack, the brush 120 is compressed, which can decrease the width of the circular groove 120*a* and/or the annulus groove 120*b*. The negative angle-of-attack also conceals the circular groove 120*a* and the annulus groove 120*b* from the person's skin. More specifically, the grooves 120*a*, 120*b* are oriented towards the person's skin, but are opposite the direction of the stroke.

The user can increase or decrease the angle-of-attack, the net interference between the brush and the person's skin, and the direction of the brush stroke. By increasing or decreasing these variables, the compression and spreading of the brush 120, as well as the presentation and concealment of the grooves 120*a*, 120*b*, can be used to modulate the application of the makeup. For example, as used in FIG. 5A, the brush makeup applicator having grooves 100 presents the grooves 120*a*, 120*b* to the person's skin. Accordingly, the brush 120 spreads apart which may cause the makeup to be retained in the brush 120. However, the user may decrease the angle-of-attack from that shown in FIG. 5A such that the makeup in the grooves 120*a*, 120*b* is applied to the person's skin. As can be appreciated, the compression of the brush 120 as shown in FIG. 5B, can effectively squeeze the makeup from the grooves 120*a*, 120*b* onto the person's skin.

As can also be appreciated, the positive angle-of-attack results in more of the brush 120 being pressed against the person's skin for a given net interference when compared to the negative angle-of-attack. Accordingly, the user may prefer the negative angle-of-attack to apply make up to a person's skin and the positive angle-of-attack when distributing or spreading the already applied makeup over a person's skin.

The user can also employ the circular groove 120*a* and the annulus groove 120*b* to modulate the application of the makeup. For example, the user can deposit a foundation in the circular groove 120*a* and a moisturizer in the annulus groove 120*b*. As a result, if the user employs the negative angle-of-attack shown in FIG. 5B, which conceals both of the grooves 120*a*, 120*b*, but compresses the annulus groove 120*b*, more moisturizer may be squeezed onto the person's skin than the foundation. Conversely, if the user employs the positive angle-of-attack shown in FIG. 5A, a more equal ratio of moisturizer and foundation may be applied to the person's face. In addition, the combined amount of the moisturizer and foundation applied to the person's face by using the positive angle-of-attack may be relatively moderate compared to the amount of makeup applied due to the compression of the brush 120 shown in FIG. 5B resulting from the negative angle-of-attack.

In operation, the brush makeup applicator can be loaded with makeup by depositing the makeup in the circular and/or the annulus grooves. For example, the circular groove 120*a* may be loaded with a foundation and the annulus groove 120*b* can be loaded with a moisturizer. The depth and width of the grooves 120*a*, 120*b* can be used to gauge the amount of each type of makeup. Additionally or alternatively, each of the grooves 120*a*, 120*b* can be filled with a mixture of makeups having a ratio to achieve a desired effect. For example, the user may choose to mix the foundation with the moisturizer at a relatively low foundation/moisturizer ratio in the circular groove 120*a* to ensure that a relatively high moisturizing content is applied to the driest portion of the user's skin in a dabbing stroke.

The user can control the distribution of each type of makeup by modulating the pressure and brushing strokes as described above, or in other ways, to apply the makeup to the skin. For example, some users may employ a spiral brush pattern in which the makeup or mixture of makeups in the circular groove 120*a* is applied predominately to the center of the spiral brush pattern. The makeup in the annulus groove 120*b* can be a different makeup or mixture of makeup that will be predominately disposed at the outer region of the spiral brush pattern. Accordingly, the grooves 120*a*, 120*b* allow the user to not only apply a desired amount of makeup without loading the brush makeup applicator having grooves 100 multiple times, but also to modulate the amount and ratios of two or more makeups over a region of skin.

The detailed descriptions of the above embodiments are not exhaustive descriptions of all embodiments contemplated by the inventors to be within the scope of the present description. Indeed, persons skilled in the art will recognize that certain elements of the above-described embodiments may variously be combined or eliminated to create further embodiments, and such further embodiments fall within the scope and teachings of the present description. It will also be apparent to those of ordinary skill in the art that the above-described embodiments may be combined in whole or in part to create additional embodiments within the scope and teachings of the present description.

Thus, although specific embodiments are described herein for illustrative purposes, various equivalent modifications are possible within the scope of the present description, as those skilled in the relevant art will recognize. The teachings provided herein can be applied to other brush makeup applicators and not just to the embodiments described above and shown in the accompanying figures. Accordingly, the scope of the embodiments described above should be determined from the following claims.

The invention claimed is:

1. A brush makeup applicator having grooves, comprising:

a handle having a first end and a second end, said first end and second end being disposed along an axis (Y-Y) of the handle; and a brush affixed to and extending away from the first end, the brush including a substantially planar first surface, which is angled relative to the axis (Y-Y), wherein said brush includes:

a circular groove formed in the substantially planar first surface, and an annulus groove formed in the substantially planar first surface, wherein said annulus groove surrounds the circular groove, and wherein bottom surfaces of the circular groove and the annulus groove define a second substantially planar surface that is at an angle relative to the axis (Y-Y) and substantially parallel to the substantially planar first surface.

2. The brush makeup applicator having grooves of claim 1, wherein the circular groove has a center that is collocated with the axis (Y-Y) of the handle.

3. The brush makeup applicator having grooves of claim 1, wherein the annulus groove has a center that is collocated with the axis (Y-Y) of the handle.

4. The brush makeup applicator having grooves of claim 1, wherein the axis (Y-Y) is a longitudinal axis of the handle.

5. The brush makeup applicator having grooves of claim 1, wherein the circular groove and the annulus groove each have a rectangular cross-section.

6. The brush makeup applicator having grooves of claim 1, wherein the handle comprises a first portion having a smooth surface at the first end and a second portion having a textured surface at the second end.

7. The brush makeup applicator having grooves of claim 1, wherein bristles in the brush extend away from the first end substantially parallel to the axis (Y-Y) of the handle.

8. The brush makeup applicator having grooves of claim 1, wherein the brush extends away from the first end in a substantially conical shape.

9. A method of forming a brush makeup applicator having grooves, the method comprising:

forming a handle having a first end and a second end, said first end and second end being disposed along an axis of the handle;

forming and affixing a brush to the first end such that the brush extends away from the first end and comprises a substantially planar first surface that is angled relative to the axis of the handle;

forming a circular groove in the substantially planar first surface; and forming an annulus groove in the substantially planar first surface, wherein said annulus groove surrounds the circular groove, wherein bottom surfaces of the circular groove and the annulus groove define a second substantially planar surface that is at an angle relative to the axis and substantially parallel to the substantially planar first surface.

10. The method of claim 9, wherein the circular groove has a center that is collocated with the axis of the handle.

11. The method of claim 9, wherein the annulus groove has a center that is collocated with the axis of the handle.

12. The method of claim 9, wherein the axis comprises a longitudinal axis of the handle.

13. The method of claim 9, wherein the circular groove and the annulus groove each have a rectangular cross-section.

14. The method of claim 9, wherein the handle comprises a first portion having a smooth surface at the first end and a second portion having a textured surface at the second end.

15. The method of claim 9, wherein bristles in the brush extend away from the first end substantially parallel to the axis of the handle.

16. The method of claim 9, wherein the brush extends away from the first end in a substantially conical shape.

17. A makeup brush, comprising:

a handle having a first end and a second end disposed along an axis; and a brush affixed to and extending away from the first end, the brush including a sloped upper surface, a circular groove formed in the sloped upper surface, and an annulus groove formed in the sloped upper surface, wherein the annulus groove circumscribes the circular groove, wherein bottom surfaces of the annulus groove and circular groove are angled relative to the axis, and wherein the sloped upper surface is substantially parallel to the bottom surfaces.

* * * * *